US009511373B2

(12) United States Patent
Bengel et al.

(10) Patent No.: US 9,511,373 B2
(45) Date of Patent: Dec. 6, 2016

(54) METHOD AND DEVICE FOR PRODUCING ORGANIC FIBROUS MATERIALS OR GRANULAR MATERIALS

(75) Inventors: Wolfgang Bengel, Tuebingen (DE); Stepan Kusche, Ostringen/Odenheim (DE)

(73) Assignee: Wolfgang Bengel, Tuebingen (DE)

( * ) Notice: Subject to any disclaimer, the term of this patent is extended or adjusted under 35 U.S.C. 154(b) by 44 days.

(21) Appl. No.: 14/236,720

(22) PCT Filed: Aug. 3, 2012

(86) PCT No.: PCT/EP2012/065252
§ 371 (c)(1),
(2), (4) Date: Apr. 4, 2014

(87) PCT Pub. No.: WO2013/017687
PCT Pub. Date: Feb. 7, 2013

(65) Prior Publication Data

US 2014/0203119 A1 Jul. 24, 2014

(30) Foreign Application Priority Data

Aug. 3, 2011 (DE) ..... 10 2011 080 375

(51) Int. Cl.

| | |
|---|---|
| ***B02C 11/04*** | (2006.01) |
| ***B02C 13/14*** | (2006.01) |
| ***B02C 13/286*** | (2006.01) |
| ***B02C 19/00*** | (2006.01) |
| ***B02C 23/08*** | (2006.01) |

(52) U.S. Cl.
CPC ..... *B02C 11/04* (2013.01); *B02C 13/14* (2013.01); *B02C 13/286* (2013.01); *B02C 19/005* (2013.01); *B02C 23/08* (2013.01)

(58) Field of Classification Search
CPC ..... B02C 23/08; B02C 23/12; B02C 19/18
(Continued)

(56) References Cited

U.S. PATENT DOCUMENTS 3,268,179 A * 8/1966 Glynn et al. ..... 241/19
4,069,979 A * 1/1978 Morita et al. ..... 241/5
(Continued)

FOREIGN PATENT DOCUMENTS

BE 764795 A * 8/1971
CA 2 594 861 A1 7/2005
(Continued)

OTHER PUBLICATIONS

Translation for BE764795 is Included As "BE764795_English_Translation.Pdf".*

(Continued)

*Primary Examiner* — Faye Francis
*Assistant Examiner* — Onekki Jolly
(74) *Attorney, Agent, or Firm* — Davis & Bujold PLLC; Michael J. Bujold

(57) ABSTRACT

A method and a device for the cold mechanical production of organic fibrous materials or granular materials. At least one load having organic material containing fibers is introduced into an interior (2) of a device (1) for breaking up the materials via an impact loading. During operation, the at least one load is broken up, in the interior (2), via an impact loading. Following processing, an organic fibrous material or an organic granular material is removed from the interior (2).

12 Claims, 3 Drawing Sheets

(58) Field of Classification Search
USPC ..... 241/14, 24.19, 24.29, 27, 28, 80, 97, 60, 241/57
See application file for complete search history.

(56) References Cited

U.S. PATENT DOCUMENTS

| | | | | |
|---|---|---|---|---|
| 4,789,105 | A * | 12/1988 | Hosokawa | B01J 2/12 241/119 |
| 4,884,759 | A * | 12/1989 | Nelle | H01J 9/236 140/92.2 |
| 5,236,133 | A | 8/1993 | Lundquist | |
| 2010/0012756 | A1* | 1/2010 | Medoff | C08H 8/00 241/23 |
| 2010/0072312 | A1* | 3/2010 | Shiina | B02C 17/1805 241/46.11 |
| 2013/0199424 | A1* | 8/2013 | Abraham et al. | 110/205 |

FOREIGN PATENT DOCUMENTS

| | | | |
|---|---|---|---|
| DE | 199 15 154 | A1 | 9/2000 |
| DE | 102 18 424 | A1 | 12/2002 |
| DE | 102 42 770 | A1 | 3/2004 |
| DE | 10 2008 035 188 | A1 | 2/2009 |
| DE | 10 2009 053 059 | A1 | 5/2011 |
| DE | 10 2010 006 916 | A1 | 8/2011 |
| EP | 1 616 625 | A1 | 1/2006 |
| GB | 1 346 271 | | 2/1974 |
| WO | 97/18071 | A1 | 5/1997 |
| WO | WO 2011095295 | A2 * | 8/2011 |

OTHER PUBLICATIONS

German Office Action Corresponding to 10 2011 080 375.0 mailed Jun. 12, 2012.
International Search Report Corresponding to PCT/EP2012/065252 mailed Apr. 24, 2013.
Written Opinion Corresponding to PCT/EP2012/065252 mailed Apr. 24, 2013.

* cited by examiner

METHOD AND DEVICE FOR PRODUCING ORGANIC FIBROUS MATERIALS OR GRANULAR MATERIALS

This application is a National Stage completion of PCT/EP2012/065252 filed Aug. 3, 2012, which claims priority from German patent application serial no. 10 2011 080 375.0 filed Aug. 3, 2011.

FIELD OF THE INVENTION

The present invention relates to a method and a device for producing organic fibrous materials and/or granular materials, in which a charge is crushed by means of an impact load in an interior of a device for the crushing of materials.

BACKGROUND OF THE INVENTION

DE 199 15 154 A1 shows a method for producing porous composite materials from renewable raw materials by combination and thermomechanical processing and hydrothermal treatment. In this method, wooden parts are crushed by means of a shredder and are subsequently defiberized with the addition of a magnesium/calcium mixture and biogenic silicic acid in a twin-screw extruder plant, wherein cell structures and lignin bonds in the wood are broken up with the aid of pressure, temperature and mechanical working.

From DE 102 42 770 A1 a method for producing wood-fiber insulation boards, in which wood chippings are ground by dry process in a refiner, is also known.

Furthermore, from WO 97/18071 A1, a method and a device for processing construction elements made of mixed plastics and other construction materials mixed therewith, such as metal parts, glass, rubber, wood, fibrous materials and the like, are known, wherein the construction elements are crushed in an agglomerator by means of an impact load and the plastics, metal, glass, rubber and wooden parts, as well as fibrous materials, are separated from one another, or the plastics are converted into granular material or as mass in the plastic state.

SUMMARY OF THE INVENTION

The object of the present invention is to provide a method and a device for producing organic fibrous materials or granular materials, which method and device are cost-effective and economical with resources.

According to the present invention, a method for producing organic fibrous materials or granular materials is proposed, in which a charge comprising at least one fiber-containing organic material is introduced into an interior of a device for crushing materials by means of an impact load and is crushed in this interior by means of impact load, wherein an organic fibrous material or an organic granular material is removed from the interior.

By a granular material within the meaning of the present invention is understood a fraction having granular components of a size varying from the macroscopic to the nm-range.

In particular, by means of the method according to the invention, an organic fibrous material and an organic granular material can also be produced in parallel.

In addition, according to the present invention, a device for producing organic fibrous materials or granular materials is provided, which device has an interior for receiving a charge comprising at least one fiber-containing organic material, wherein the device is set up to crush the charge accommodated in the interior by means of an impact load, and wherein the device further has at least one removal device for removing the fibrous material or granular material from the interior.

Unlike known energy-intensive methods for fiber extraction in the insulating material and paper industry, which use wet processes and dry processes with defiberizations in grinding devices known as refiners and in which fiberboards are pressed and dried, with the present invention a cold-mechanical processing of organic fibrous materials and granular materials by means of a device known as an impact reactor, for crushing materials by means of an impact load in a non-cutting or non-material-removing process, is enabled. Neither an energy-intensive thermal preheating process, such as the preliminary boiling of wood chippings, nor the use of large electric drives or complex drying processes is necessary. Consequently, there is only a low demand for water, thermal and electrical energy, in addition to which scarcely any waste accrues. Moreover, cost-effective raw and residual materials can be used. All in all, the method according to the invention and the device according to the invention are thus cost-effective and economical with resources. Moreover, in the device according to the invention, the mechanical tool wear is substantially less than, for example, in a refiner.

The invention finds application, inter alia, in the derived timber product industry, in the insulating material industry, in the construction material industry and, in particular, in the production of vapor diffusion-open and wind-tight ceiling and wall insulation boards, i.e. statically stable or flexible insulation boards, in the production of thermoplastically workable composite materials, in the fiber processing industry, the wood dust processing industry, the food and foodstuffs industry, as well as in specific raw material logistics. Process parameters and possible fittings in the device or in the interior thereof can be appropriately adapted or set to desired processes or to intermediate or end products.

In the device, which can be configured, in particular, as an impact reactor, one or more removal devices, such as screens or flaps, can be provided at various positions. Separation systems such as screening plants or centrifugal separators, like cyclone separators or cyclones and wet separators, can be disposed downstream of the removal devices. In principle, any chosen combinations of such elements are possible, wherein separators can be provided both in parallel and in sequence in any chosen order.

The charge can only comprise one type of a fiber-containing organic material, but it can also contain several types of such materials. For instance, the charge can consist of a mix of different fiber-containing organic materials.

An automatic control system for the method and the device can be provided. For this purpose, one or more parameters, such as the power consumption of the device, the geometry of the device, the dwell time of the charge in the device, or the degree of filling of the interior of the device can be used.

In order to prevent premature drying of (wood) fibers, which thereupon become brittle and can break, within the device, a heating of the charge introduced into the device is advantageously avoided. Preferably, the operating temperature of the device is therefore less than about 50° C. For the cooling, granular dry ice, as is also used as a sand substitute for sandblasting processes, can be provided for instance. Dry ice is advantageous because it, on the one hand, increases the fill level of the device and, on the other hand, further promotes the crushing operation, yet does not further moisten the reaction product. The fitting of cooling ribs into the outer walls of the reaction chamber, or the drawing-in of cooling air, can also serve to control the temperature of the reaction chamber.

With the present invention, it is possible to utilize, in particular, residual wood charges which could not previously be used for fiber extraction, whereby, once again, considerable savings in production costs are obtained. Preferably, the fiber-containing organic material is therefore constituted by wood, and/or by a wood-like material, and/or by a primary shredder product, for instance of chopping areas, and/or by a residual material from paper production, and/or by waste paper, and/or by straw, and/or by grain husks, and/or by harvest residues from agriculture. For instance, the material can be constituted by rough wood such as wood chippings, wood off-cuts, residual wood from the paper industry, woody components from hedges and shrub cuttings, timbers from short-rotation plantations (SRC), or by other wood-like and fiber-containing biomasses. In particular, a processing of bark, in particular of softwood bark as the waste product from sawmills, is also conceivable. An admixture of hardwood to the softwood in an approximately 10% to 15% share proves particularly advantageous, since the quality of the generated fibers is improved to the point where longer fibers having a length of more than 2.5 mm can be acquired. As a result, fibers for the production of high-density insulation boards made of derived timber products, blow-in insulating materials made of wood and cellulose fibers can be acquired. In addition, fibers or granular material for injection-moldable and extrudable biopolymers, as well as so-called wood-plastic composite or WPC, can be acquired.

For the generation of fibrous materials, it is advantageous if the starting material contains a specific water component, preferably approx. between 35 and 55% by weight. In the case of a lower moisture component, granular materials are primarily generated.

Particularly preferably, the relationship between the volume of the charge and the volume of the interior prior to use of the impact load lies below 6% or 5%, or between 3% and 6%, or between 3% and 5%. This relationship or the fill level of the device can be measured, for instance, via the workload of a motor which drives the device. Where the fill level lies above 6%, the velocity of particles of the charge which move in the interior falls, or the charge is no longer defiberized and is merely agitated and heated. Where the motor is constituted by a two-pole motor, a speed of 2800 rpm, or a speed between 1800 rpm and 3000 rpm, is preferably set for said motor. The achievement of a specific peripheral velocity of the rotor is crucial.

In a preferred embodiment, the fibrous material or the granular material is removed at least partially by suction from the interior of the device, and/or the fibrous material and/or the granular material is removed at least partially during operation of the device from the interior thereof. For the extraction, the removal device can have at least one extraction pipe projecting into the interior. Particularly preferably, the extraction pipe is slidable with variable penetration depth into the interior, and/or is pivotable and/or displaceable perpendicular to a longitudinal axis of the interior, and/or is pivotable and/or displaceable parallel to a longitudinal axis of the interior, in order to be able to extract the fibrous material or granular material from the interior at different points therein. The extraction can be realized, according to the nature of the generated turbulence and desired fiber quality, additionally or alternatively also above the actual impact chamber; where two or more extractions are used, their draw-off relationship one to another can be made adjustable. Parallel to the extraction, the removal of a screen fraction containing both considerable fibrous material and coarse material components can additionally be provided. Coarse materials of this type can then be screened out by means of a screen cascade.

In the interior of the device according to the invention, one or more guide or blade elements can be provided in order to direct air streams or material flows in the interior. Where the removal device has an extraction pipe, then this is preferably disposed on the lee side of the guide or blade element in order to prevent unwanted penetration of material into the extraction pipe and thereby obtain the best possible suction results.

In order to be able during operation to ensure an extraction cross section, and thus a material flow, which is as constant as possible, the extraction pipe can be equipped with a cleaning device, in particular a preferably displaceable screw.

The fibrous material and/or the granular material can be removed from the interior either continuously and/or discontinuously. Thus the fibrous material can be continuously extracted from the interior, for instance, during operation of the device, while coarse parts are removed from the interior after certain time intervals by a flap or a screen.

Advantageously, a part of the organic material can be removed from the interior and subsequently reintroduced into this. For instance, coarse parts which have accidentally been jointly extracted and have not yet been crushed to a predefined size can be fed back into the device in order there to be further crushed.

As the conveying air or intake air, a gas having an oxygen component of less than 13%, or cold flue gas, which has been dedusted, in particular, by means of a fine dust filter, can advantageously be fed into the interior. This is advantageous, in particular, when the fibrous materials or granular materials are dry and dust-forming and thus potentially explosive, since the addition of such a gas lessens the risk of explosion. Incorporation on the flue side and heat side into a biomass power station, in which, particularly preferably, from the organic solids and granular materials which are to be crushed, components which prior to the crushing have been separated out as being materially unusable are burnt, is preferred.

The charge can be introduced into the interior by means of a mechanical or pneumatic metering device. It can here be conveyed via belts, feed rollers, spiked rollers, crushers or screws and can be introduced in various batch divisions, material mixtures and degrees of moisture.

Through a suitable choice of metering device, a preliminary crushing, or a preconditioning of the material, for instance, can be achieved.

Since the fibrous material and/or the granular material is surveyed ultrasonically or optically with respect to particle size at discrete moments or continuously, a constant process monitoring with a view to optimal quality of the obtained product can be achieved. For instance, measuring points, such as optical measuring devices, can be provided at the end of an extraction pipe of the removal device, or else in the interior of the device according to the invention, so as there to measure the moisture and the temperature. Thus, during the implementation of the method according to the invention, the fiber quality can be determined in situ by means of a high-speed camera in conjunction with an image evaluation or a particle measuring unit and, where appropriate, can be used as an input variable for an adjustment of the intake pipe.

BRIEF DESCRIPTION OF THE DRAWINGS

The invention is explained in greater detail below with reference to illustrative embodiments with the aid of figures, wherein.

DETAILED DESCRIPTION OF THE PREFERRED EMBODIMENTS

Figure 1B:
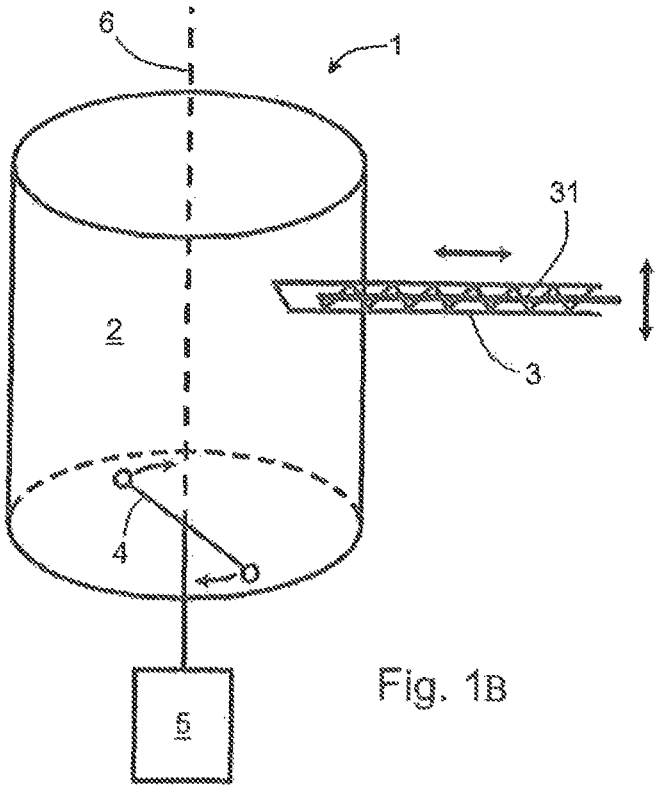
FIG. 1 shows a simplified schematic representation of a device according to the invention, in three-dimensional view and in top view.
Figure 1A:
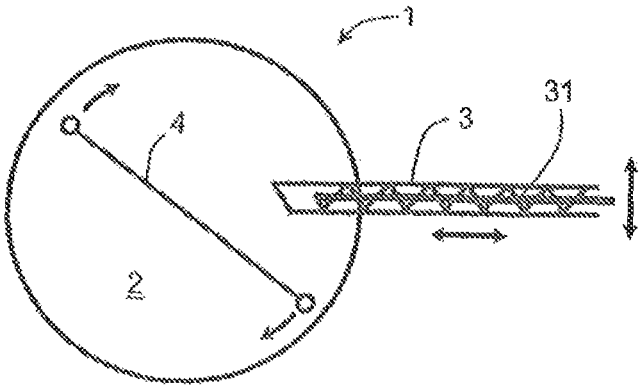

A heavily simplified and schematic representation of a device 1 according to the invention is represented in FIG. 1. A cylindrical interior 2 of the device 1 known as an impact reactor can be seen, into which interior an extraction pipe 3 of a removal device (not represented in detail) projects. In addition, close to the floor of the interior 2, a rotor 4 is disposed in the interior 2, which rotor can be set in rotation by a drive motor 5 positioned outside the interior 2.

In order to crush a charge of a fiber-containing organic material, the charge is filled into the interior 2 of the impact reactor 1 by means of a metering device (not represented in the figure). The filling operation is supported by the underpressure formed during operation of the impact reactor 1. In the case of a filling from above, gravitational force likewise acts supportingly. In parallel, a filling by means of, for instance, a feed screw can also be realized from the side or tangentially into the interior. By means of the drive motor 5, the rotor 4 is set in rotation. The, in FIG. 1, clockwise rotating rotor 4 generates in the interior 2, at appropriate rotation speed, an air vortex which rotates in the same rotational direction as the rotor 4 and which entrains and swirls the fiber-containing organic material filled into the interior 2. This produces multiple impacts of the material against the wall of the interior 2 and/or against impact elements (not represented in the figure) and the rotor 4, but also of parts of the material one against the other. As a consequence of these sometimes very violent impacts, the material is crushed or defiberized. The strongly spontaneous mechanical force application heats the moist woody parts to the evaporation point and thus contributes to the crushing, without destruction of the individual fibers. Depending on the rotation speed, the time and the nature and moisture content of the material, said material can be split down into individual fibers.

Through the admixture of fine-structured, wood-like material, such as, for instance, green waste or SRC material, a damping effect, which leads to an improvement in fiber quality, can be achieved. In particular, admixtures of approx. 10-20% by weight green waste to softwood chippings are advantageous here.

Since, due to the formed centrifugal forces and the inertia, heavier particles move on a trajectory with greater radius than lighter particles, the size of the crushed material in the air vortex decreases in the direction of the middle of the interior 2 or in the direction of the longitudinal axis 6 thereof. By means of the extraction pipe 3, which, as indicated by the double arrows in FIG. 1, can be slid as far as required into the interior 2 and is pivotable or displaceable perpendicular and parallel to the longitudinal axis 6 of the interior 2, fibrous materials or granular materials of different sizes, which have emerged from the crushed organic material during operation of the impact reactor 1, can be extracted from the interior 2 by appropriate positioning of an opening in the extraction pipe 3 in the interior 2. The opening in the extraction pipe 3 can here be positioned on a side facing away from the air vortex prevailing in the interior 2. In other words, the opening is disposed on the lee side of the air vortex.

The extraction pipe 3 is equipped with the cleaning unit 31, which in the present example is configured as a screw and, where appropriate, is reversible and with which a clogging of the extraction pipe by the extracted material can be avoided. Where appropriate, the cleaning unit 31 can also be dispensed with. Thus, in order to prevent the accumulation of moist fiber material in the interior of the extraction pipe 3, in place of the cleaning unit 31 configured as a screw, a double-walled extraction pipe with injection nozzles can be provided. Hence, on the one hand, as a result of a cyclical build-up of an overpressure in the double wall, a cleaning of the inner side of the pipe can be performed. Alternatively or additionally, as a result of a constant overpressure in the double wall, a type of air cushion can be generated in the region of the inner wall of the extraction pipe 3, whereby moist fibrous material is kept remote from the wall and an accumulation thereof can be prevented.

Figure 2:
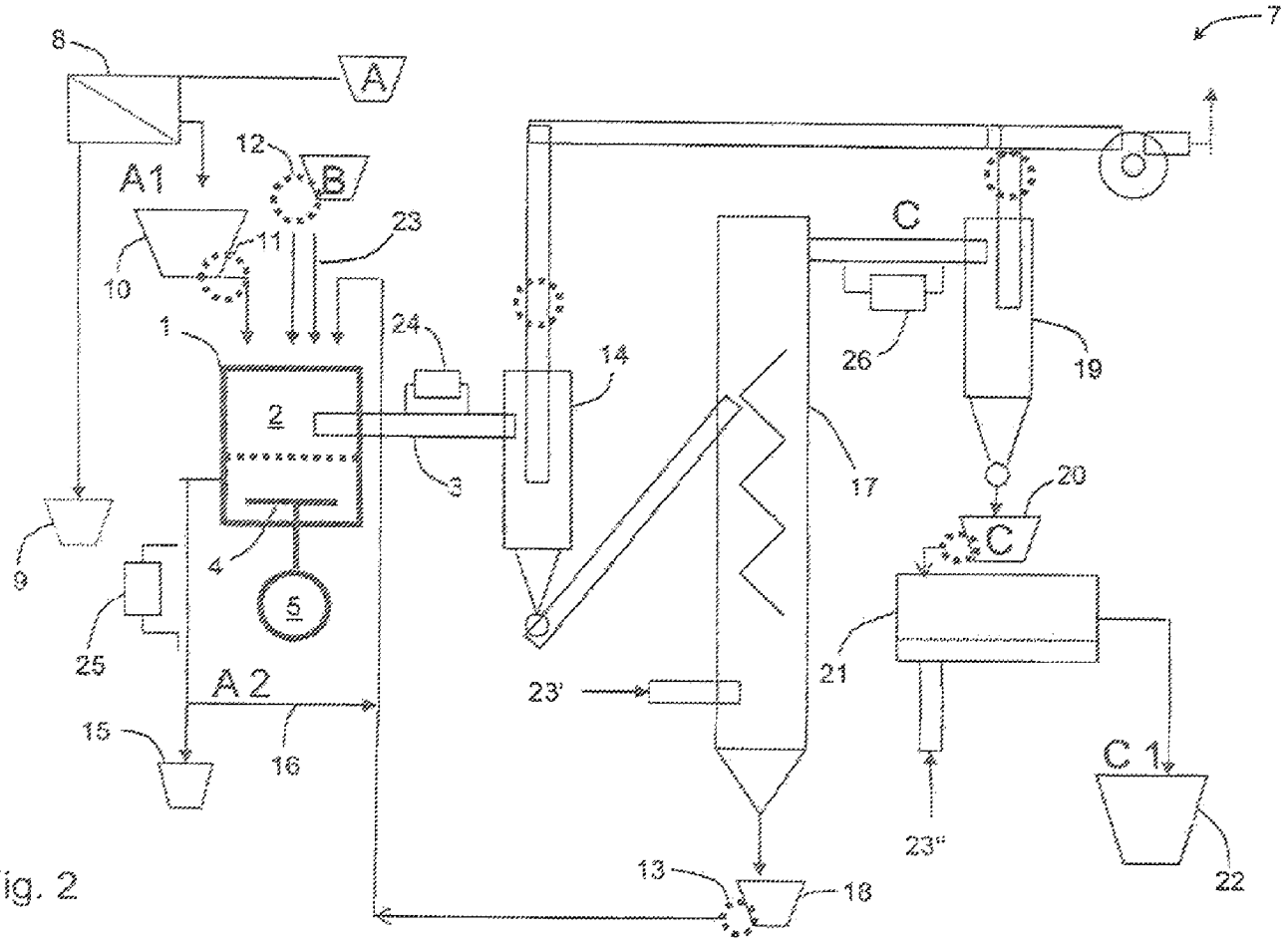
FIG. 2 shows a plant having a device according to the invention.

In FIG. 2, the impact reactor 1 is shown as a component of a larger plant 7 for producing fibrous material from rough wood (A) accruing in different fractions. Below, individual components of the plant 7, as well as their functionalities in the overall operation of the plant 7, are described.

Said rough wood (A) is constituted, for instance, by wood chippings, primary shredder product, or wood-like residues of approx. 250 mm to 300 mm in length and having an approximate diameter of up to about 100 mm, wherein around 10% to 15% shares of the rough wood (A) consist of hardwood, which are cleaned, classified and homogenized in a separator 8 of the plant 7, such as, for example, a gravity sifter, a star screen, a drum screen or an impact reactor similar to the impact reactor 1. Where an impact reactor is used as the separator 8, this can be equipped with screens or flaps for the material removal; otherwise, it can be substantially identical in construction to the impact reactor 1. Similarly, it is conceivable to use in total only one impact reactor, which can be used sequentially as a classifier or pre-classifier (cf. reference symbol 8) and as a defiberizer (cf. reference symbol 1). The classification of the rough wood (A) in an impact reactor is here preferred, since, in addition to a first crushing of the rough wood (A), an extensive homogenization, demineralization and debarking can also be realized in a single work cycle. Grain components 9 which are unusable for further material use, since they contain, for instance, a high mineral component or a high share of extraneous materials or bark components, are discharged and can be supplied, for instance, for thermal use. It is thus possible, for example, to provide in the plant 7 a biomass power station in order to generate heat from the grain components 9 by burning and to utilize this heat at another location in the plant 7, for example as drying heat.

Screened grain A1 which accrues from the separator 8 as oversize material or undersize material is first conveyed into a metering tank 10 and from there, via a metering device 11, into the impact reactor 1. Various further wood fractions or additives, such as, for example, bonding agents, fire or pest inhibitors, can be filled as supplementary material (B) by means of the metering device 12 additionally into the impact reactor 1, likewise, screened grain 18, which, as explained in greater detail below, is fed back into the impact reactor 1 by means of the metering device 13 in order to produce a suitable target grain. For instance, for the production of insulating material, a target grain having a high share of isolated natural fibers having a length of 0.5 mm to 3.5 mm and a diameter of 0.02 mm to 0.06 mm is necessary, or fiber bundles consisting of three to ten individual fibers of appropriate length are necessary. A charge, consisting of said starting materials, of the impact reactor 1 occupies between 3% and 6% of the interior 2 of the impact reactor 1.

In the impact reactor 1, an air vortex, by which particles of the charge, in addition to the direct impacts by the rotor 4 itself, are accelerated to velocities between 80 m/s and 130 m/s and are crushed by means of impact load, is now generated with the rotor 4 driven by the drive motor 5.

The products formed as a consequence of the impact load can be extracted from the interior 2 continuously or discontinuously via the extraction pipe 3. Since the depth of penetration of the extraction pipe 3 into the interior 2 is adjustable, and since the extraction pipe 3 is vertically and horizontally pivotable or displaceable, the extraction pipe 3 can be adjusted such that only products having desired fiber sizes or fiber qualities are extracted. In this context, the pipe dimension and the design of the extraction opening are further important factors. In a downstream cyclone 14 of the plant 7, these extracted products are separated off.

Where necessary, products can also however, be extracted discontinuously from the impact reactor 1, collected in a container 15 and supplied for further use, for instance for thermal use. The return of the products A2 via a supply line 16 back into the impact reactor 1 is also possible.

Following on from the cyclone 14, the products are conveyed into a further gravity separator 17, such as, for example, a zigzag sifter, and are separated off there according to desired target fractions (C). Alternatively, a screening plant can also be used. Oversize material is here extracted from the gravity separator 17 or the screening plant into a container 18 and is fed back into the impact reactor 1 by means of the metering device 13 for renewed defiberization. The gravity separator 17 can be fed the gas stream 23, which can stem from the same source as the gas stream 23.

Via a further cyclone 19, a renewed separation of the target fractions (C) is realized. The target grain which here accrues can subsequently be fed into a buffer store 20 and then, via a metering facility, to a dryer 21. In the latter, the target grain (C1) is dried to a predefined final moisture. For this, heat which is acquired in the above-stated biomass power station by burning, for instance, of the grain components 9 and in the dryer 21 by means of the gas stream 23", is used. The target grain (C1) exists finally as ready-to-use end product, for instance, in the form of a fiber quantity as the primary or secondary raw material in a bunker 22 of the plant 7. The end product can have fibers of 0.5 mm to 2.5 mm in length and a diameter of 20 μm to 60 μm, for instance.

Where said initial and intermediate products (A, B, C) are already dry or dust-forming and thus potentially explosive, a gas 23 with low oxygen component, preferably a dry flue gas, is led as the conveying air or intake air with suitable temperature into the impact reactor 1. Here, a flue-gas side and heat-side incorporation into a biomass power station and, in particular, into the aforementioned biomass power station in which the grain components 9 are burnt, is necessary.

At various locations 24, 25, 26 in the plant 7, the quality and quantity of the screened grain is measured continuously. For this, an ultrasonic measuring method, in particular, is suitable. Via a summation from the measuring points 24, 25, 26, the metering devices, and thus the fill volume of the impact reactor 1, are regulated. The process control is here intended to ensure an, as far as possible, continuous production process with appropriate screened grain quality.

In the described plant 7, the quality of the fibers produced in the impact reactor 1 depends on various factors, including the unit size, the wood type and the moisture content, as well as the bulk density of the charge materials, the degree of filling of the interior 2, the geometry and volume of the interior 2, the configuration of the rotor 4 and of possibly provided impact bodies, angles and distances of the rotor 4 from the walls of the interior 2, the centrifugal acceleration of the materials, the feed and discharge members of the impact reactor 1, the air circulation and flow through the interior 2, as well as the average distance traveled by particles in the interior 2.

It has been shown that, in particular, the degree of filling of the impact reactor 1 is particularly suitable as the control or regulating variable. Degrees of filling within the range of 3-6% are advantageous.

Figure 3:
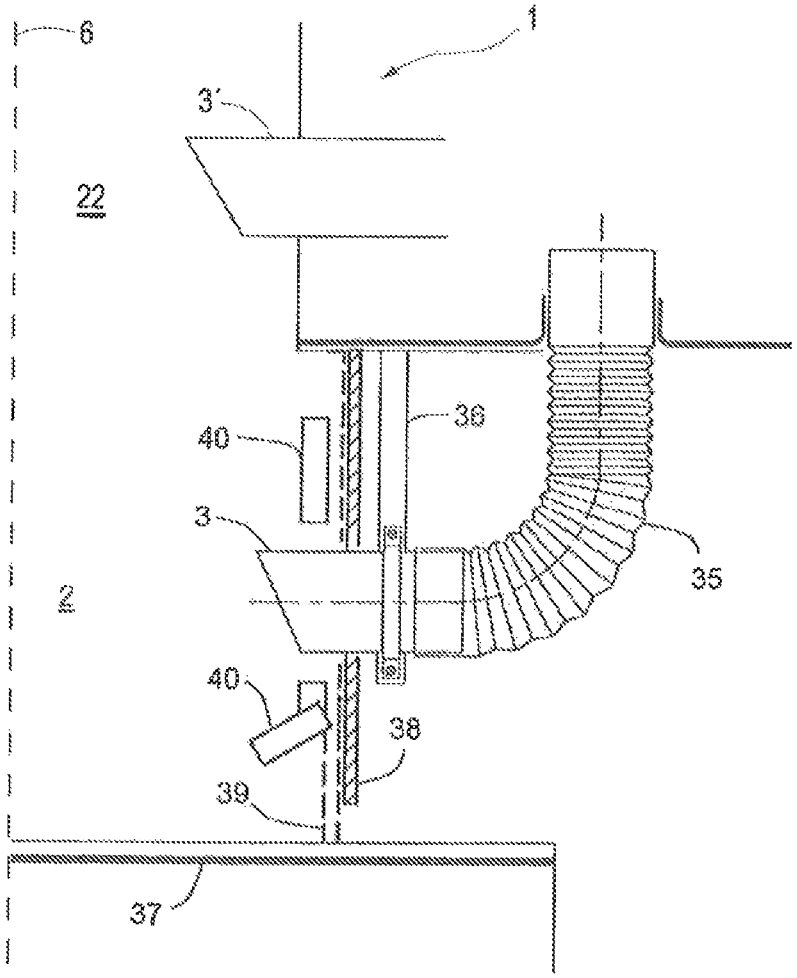
FIG. 3 shows an adjustable extraction pipe of a device according to the invention.

In FIG. 3, that region of the impact reactor 1 in which the extraction pipe 3 projects into the interior 2 thereof can be seen once again with greater precision. The extraction pipe 3 is constituted by a pipe connected to an extraction hose 35. The extraction pipe 3, held by a mounting 36, pierces above the floor 37 of the impact reactor 1 the wall thereof, which wall comprises a cover plate 38 facing away from the interior 2 and a screen plate 39 facing toward the interior 2. In the interior 2, adjacent to the extraction pipe 3, deflector blades 40 are attached to the screening plate 39 in such a way that the opening in the extraction pipe 3 is located during operation of the impact reactor 1 on the lee side of the deflector blades 40. The deflector blades 40, which are adjustable in height and angle, ensure that no material can accidentally penetrate into the extraction pipe 3. Likewise clearly discernible in FIG. 3 is a further extraction pipe 3', which is disposed in a region 22 above that region of the interior in which the crushing primarily takes place. In principle, the possibility exists of equipping the impact reactor 1 with both pipes 3 and 3' or only with one of said pipes.

The invention claimed is:

1. A method of producing organic fibrous materials or organic granular materials, comprising the steps of:

introducing a charge comprising at least one fiber-containing organic material into an interior of a device for crushing materials by means of an impact load, crushing the charge in this interior of the device by means of impact load, and removing one of the organic fibrous material or the organic granular material from the interior by means of an extraction pipe, obtaining isolated natural fibers having a length of 0.5 mm to 3.5 mm and a diameter of 0.02 mm to 0.06 mm, surveying the organic fibrous material or the organic granular material, with respect to a particle size, by one of ultrasonically or optically at discrete moments or continuously, cleaning of the inner side of the extraction pipe by means of a cleaning unit, cooling the charge by means of granular dry ice, wherein the relationship between a volume of the charge and a volume of the interior of the device, prior to use of the impact load, is below 6%.

2. The method according to claim 1, further comprising the step of using at least one of wood, a wooden material, a primary shredder product, a residual material from paper production, a waste paper, straw, grain husks, harvest residues from agriculture, green waste, or a combination of more than one of the aforementioned materials as the fiber-containing organic material.

3. The method according to claim 1, wherein the relationship between a volume of the charge and a volume of the interior of the device, prior to use of the impact load, is between 3% and 6%.

4. The method according to claim 1, wherein the relationship between a volume of the charge and a volume of the interior of the device, prior to use of the impact load, is between 3% and 5%.

5. The method according to claim 1, further comprising the step of at least partially removing the organic fibrous material or the organic granular material by suction from the interior of the device.

6. The method according to claim 1, further comprising the step of at least partially removing the organic fibrous material or the organic granular material during operation of the device from the interior of the device.

7. The method according to claim 1, further comprising the step of continuously removing the organic fibrous material or organic granular material from the interior of the device.

8. The method according to claim 1, further comprising the step of discontinuously removing the organic fibrous material or organic granular material from the interior of the device.

9. The method according to claim 1, further comprising the step of removing a part of the organic fibrous material from the interior and subsequently reintroduced the removed part into the interior of the device.

10. The method according to claim 1, further comprising the step of feeding, as a conveying air or intake air, a gas having an oxygen content of less than 13% into the interior of the device.

11. The method according to claim 1, further comprising the step of feeding, as a conveying air or intake air, a flue gas into the interior of the device.

12. The method according to claim 1, further comprising the step of introducing the charge into the interior of the device via a mechanical metering device.

* * * * *